US007938685B2

(12) United States Patent
Zwanger

(10) Patent No.: US 7,938,685 B2
(45) Date of Patent: May 10, 2011

(54) ZINC DIE-CAST HOUSING FOR A PLUG CONNECTOR

(75) Inventor: Michael Zwanger, Sulz (DE)

(73) Assignee: Lapp Engineering & Co., Cham (CH)

( * ) Notice: Subject to any disclaimer, the term of this patent is extended or adjusted under 35 U.S.C. 154(b) by 0 days.

(21) Appl. No.: 12/619,358

(22) Filed: Nov. 16, 2009

(65) Prior Publication Data

US 2010/0136833 A1 Jun. 3, 2010

(30) Foreign Application Priority Data

Nov. 28, 2008 (DE) ..... 10 2008 059 583

(51) Int. Cl.
*H01R 9/03* (2006.01)

(52) U.S. Cl. ..... 439/607.55; 439/372

(58) Field of Classification Search ..... 439/607.55, 439/372, 308

See application file for complete search history.

(56) References Cited

U.S. PATENT DOCUMENTS

| | | | | |
|---|---|---|---|---|
| 3,760,333 | A * | 9/1973 | Stieler | 439/271 |
| 5,022,866 | A * | 6/1991 | Harting et al. | 439/372 |
| 5,658,162 | A * | 8/1997 | Harting et al. | 439/372 |
| 7,597,562 | B2 * | 10/2009 | Genesius et al. | 439/76.1 |
| 7,717,723 | B2 * | 5/2010 | Nehm | 439/157 |
| 7,740,500 | B2 * | 6/2010 | Rudolph | 439/372 |
| 7,785,131 | B2 * | 8/2010 | Ferderer et al. | 439/372 |

FOREIGN PATENT DOCUMENTS

| | | |
|---|---|---|
| DE | 92 18 209 U1 | 12/1993 |
| DE | 43 39 210 C1 | 4/1995 |
| EP | 0 957 540 A2 | 11/1999 |

* cited by examiner

*Primary Examiner* — Hae Moon Hyeon

(57) ABSTRACT

The present invention relates to a zinc die-cast housing (10) for a plug connector for establishing an electrical connection between the plug connector and a socket accommodating same, wherein the housing (10) comprises at least a first and a second housing part (12, 14) which are to be joined via a locking device (16) and rigid fastening elements (18), and of which at least one housing part (12, 14) comprises a receptacle device (24) for accommodating and applying electrical contact to a cable, and wherein the rigid fastening elements (18) and the at least one receptacle device (24) each are integrally formed with the housing (10).

8 Claims, 2 Drawing Sheets

ZINC DIE-CAST HOUSING FOR A PLUG CONNECTOR

RELATED APPLICATIONS

The present invention claims priority from German Patent Application No. DE 10 2008 059 583.7, filed Nov. 28, 2008.

BACKGROUND

In the following, a zinc die-cast housing for a plug connector for establishing an electrical connection between the plug and a socket receiving said plug will be described, as well as a corresponding manufacturing method for it and the casting mould on which the housing is based.

Such plug connectors are, in particular, employed in the field of industrial control and feedback control systems and serve, for example, to connect larger electronic equipment such as, e.g., computers or industrial robots with power supplies or other electrical components.

The housing of the plug connector is usually composed of two housing parts in which insulating body inserts equipped with contact elements are respectively provided, whose contact elements come into contact when coupling the housing parts. The housing parts are kept together by means of a locking device which engages with attachment elements which are provided both on the first and the second housing part to be joined.

The purpose of the housing itself is to protect the insulating body inserts which are accommodated therein against external mechanical and electromagnetic influences. To this end, housing parts made from metal or synthetic material known in the art are manufactured which have a sufficient mechanical strength to prevent damage to the elements accommodated therein due to external effects. The housing parts may be provided with an electro-conductive coating on their surfaces, which allows an electrical connection between the two housing parts and thereby ensures an adequate protection against electromagnetic interfering influences from the outside for the contact means in the housing interior. Likewise, an electromagnetic interference radiation which occurs in the housing interior cannot escape to the outside.

Further, an elastic sealing ring may be provided for a housing of such plug connectors, which is arranged between the two housing parts in order to protect the housing interior against the ingression of dirt and humidity. In this case, however, care should be taken that the elastic sealing does not interrupt the electro-conductive connection between the housing parts. Such plug connector housings are known, e.g. from DE 92 18 209 U1, DE 43 39 210 C1, or EP 0 957 540 A2.

Practical operation, however, has also revealed several drawbacks with respect to the manufacture of the described housings according to the state of the art. These housings are presently often manufactured by means of a corresponding tool to the pressure die casting method. The material of primary choice is aluminium or aluminium alloys, respectively. Due to the relatively low electrical conductivity of aluminium and aluminium alloys, it is necessary to provide the aluminium housing parts manufactured by the die cast method in a further step with a surface coating with a better conductivity in order to enable an electrical shielding of the plug connector.

Additionally required elements such as fastening elements for mounting the locking device by means of which the two housing parts are kept together, or a receptacle device for receiving and applying electrical contact to a cable to be connected with the plug connector are subsequently installed in the housing parts, e.g., by pressing or screwing them into pre-formed holes.

In order to ensure a good and continuous electrical connection of the two housing parts, it is often required as recommended in DE 43 39 210 C1, to finish-machine the surface of the housing parts at least in the region of the contact areas by, e.g., face grinding.

Due to the fact that the die-cast aluminium housing parts have to be finish-machined in several steps, and that multiple additional single parts are required for making a housing, which have to be assembled with the housing parts within an assembling process, additional storage costs as well as assembly and manufacturing costs will accrue.

Another known disadvantage in conjunction with the aluminium die casting method or the die casting method with aluminium cast alloys, respectively, is that the maximum shot number with one tool set, i.e. the number of castings which can be manufactured with one tool set of the necessary tools for die casting, such as mould, piston, etc., is limited to approx. 100.000 pieces for plug connectors. This, in turn, results in increased manufacturing costs because with higher unit numbers the expensive tools, in particular, the high-price mould, have to be replaced.

SUMMARY

Object

Thus, it is a requirement to economically realise the manufacture of a housing for a plug connector and to simultaneously ensure a reliable electrical plug connection.

Solution

This is solved for a housing of the initially mentioned type in that two housing parts are to be joined via a locking device and rigid fastening elements. At least one housing part comprises a receptacle device for receiving and applying electrical contact to a cable. The housing is formed as a zinc die-cast housing, at which at least one receptacle device and the rigid fastening elements each are integrally formed with the housing.

Advantages and Advancements

Due to the fact that the housing parts are manufactured as zinc die castings, it is possible to reduce the investment and manufacturing costs, because the mould durability in the zinc die casting method with a maximum shot number (depending on the manufacturing method) of approx. 500.000 to approx. 3.000.000 castings is considerably higher than in the prior art. This is due to the relatively low melting point and the particularly narrow solidification interval of zinc alloys.

Furthermore, particularly close tolerances and high-quality surfaces can be achieved with zinc die casting so that mechanical finish-machining such as, e.g., thread cutting or grinding of the housing parts in the joining area, i.e. where the housing parts are in abutment for jointly forming one housing, is either not necessary or only necessary to a considerably smaller extent. The manufactured castings do not only comprise a high precision but also a high hardness and mechanical strength.

From the above-mentioned reasons it is possible to integrally form the fastening elements and the receptacle device with the housing, i.e. to make these in one cast with the respective housing part instead of installing them as separate elements in the finished castings. The surface finish and the precision of the cast fastening elements is, for example, sufficient to ensure a defined interface with the locking device to be joined therewith. The mechanical strength, too, is high enough to ensure the prevention of a shearing-off of the fastening elements under the influence of the usually occurring external forces.

Because the fastening elements and the at least one receptacle device are formed integrally with the housing, the number of single parts of a correspondingly manufactured housing and the associated cost due to storage and assembly may be reduced.

Due to the high hardness and strength of zinc and zinc alloys it is further possible to reduce the wall thicknesses of the housing parts whereby the material costs compared to aluminium die-cast housings may be reduced considerably. This, in turn, results in a weight reduction of the housing parts, so that in spite the greater mass of zinc compared to aluminium, the inventive housing is at least not heavier than the comparable aluminium die-cast housing which is known in the art. Another advantage of the reduced wall thicknesses is given by the greater air gap and creepage distance of the inventive housing compared to known aluminium die-cast housings.

An advancement of the invention may provide for a receptacle device in each housing part for the accommodation and applying of electrical contact to a cable. Such an embodiment is advantageous in particular in cases where both housing parts, apart from the receptacle device and the joining area, comprise a closed housing wall.

It may further be provided to form the rigid fastening elements as pins which protrude in pairs from the respective housing part in mutually opposing directions. In this manner, the pins arranged in pairs form an axis on the respective housing part with which the locking device may be brought in engagement. As an alternative to forming the fastening elements as pins, other variants are, however, also conceivable, e.g. a configuration as brackets or the like, in which the locking device must have corresponding means in order to cooperate with the same and by that keep the housing parts connected with each other.

The fastening elements may be arranged in pairs in mutually opposing directions on one or on both housing parts. Further, one or several pairs of the rigid fastening elements may be provided on each housing part.

The locking device may further include a longitudinal clamp which is configured to provide a connection between the rigid fastening elements of the first and second housing parts. Such a longitudinal clamp may further be configured in such a manner that it is pivotably connectable with a pair of the pin-shaped fastening elements of the first housing part. Here, the axis which is formed by the paired pins constitutes the axis of rotation for the pivoting motion of the associated longitudinal clamp. For such a pivoting motion, the longitudinal clamp may comprise fitting holes which essentially correspond to the outer diameter of the pin-shaped fastening elements and which by accommodating the pin-shaped fastening elements effect the connection between the longitudinal clamp and the fastening elements.

The longitudinal clamp may comprise a flexible portion in which these fitting holes are arranged. Alternatively, the fitting holes may be provided in a rigid portion of the longitudinal clamp, with the fitting holes being open to one side in the circumferential direction. In order to reduce friction between the pins and the fitting holes of the longitudinal clamp and to increase wear resistance of the pin-shaped fastening elements it may also be advantageous to provide bearing bushes, with the pins being formed to accommodate them. The bearing bushes are arranged between the fitting hole of the longitudinal clamp and the pin to be inserted therein, and are preferably made from a resistant material such as stainless steel.

In one embodiment of the invention, the receptacle device comprises an opening formed in the housing and a collar surrounding it. The collar may be provided with holding means for fastening the cable on the receptacle device. These holding means for fastening the cable may, for example, comprise a male thread. Alternatively, other configurations of the holding means are also conceivable, e.g. a groove for forming a locking connection or the like. A locking connection may, in particular, be advantageous if a particularly quick connection and separation of the cable with the housing part is desired. The cable is secured to the receptacle device by means of additional elements, e.g. by means of a cap nut or a corresponding top with a second corresponding locking component, by screwing the cap nut e.g. onto the male thread or by bringing the latching components into engagement with each other.

In lieu of the male thread, it is also possible to provide a female thread as a holding means for fastening the cable, for example, on the inner side of the collar. In this case, the cap nut comprises a portion with a male thread which corresponds to the female thread of the collar and contributes to securing the cable at the receptacle device.

In order to prevent the ingression of dirt or humidity into the housing interior, the housing parts of one embodiment of the invention are adapted for the sandwich-type arrangement of a sealing member. Such a sealing member may, for example, be made from an elastomeric material and may correspond essentially to the circumference of the housing parts in their contact area.

Alternatively, other embodiments are also conceivable in which a sealing member is arranged between the housing parts in such a manner that a tight connection of the housing parts is enabled. One example for this may be a labyrinth seal which ensures a tight connection by the arrangement of the walls of the housing parts and the sealing member in the joining area of the housing parts. In this case, the first housing part may, for example, overlap the second housing part at least partially in the assembled condition of the housing.

The invention also relates to a method for the manufacture of a zinc die-cast housing with the above mentioned features which comprises the following step: die-casting the first and second housing parts including the rigid fastening elements and the receptacle device. This method is particularly advantageous in that further machining steps such a thread cutting on or in the receptacle device can be omitted because the thread is already formed during die-casting of the first and the second housing parts including the rigid fastening elements and the receptacle device.

The invention also relates to a casting mould for die casting of a zinc die-cast housing with the above mentioned features according to the above mentioned method, with portions of the casting mould being adapted to form the fastening elements and the receptacle device of the housing.

DETAILED DESCRIPTION OF THE FIGURES

Figure 1:
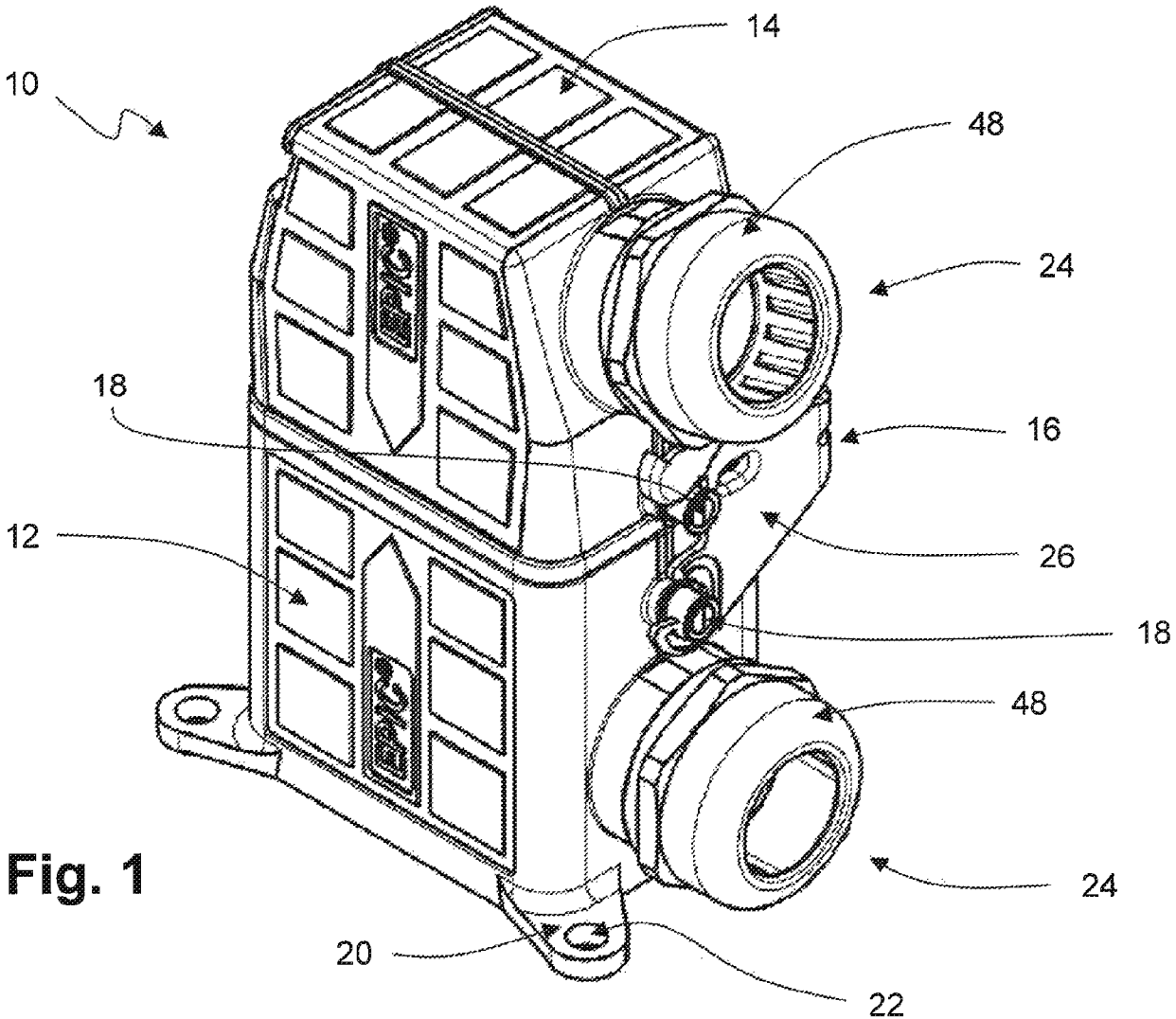
FIG. 1 shows an isometric view of the inventive zinc die-cast housing for a plug connector in assembled condition.

FIG. 1 shows an isometric view of a zinc die-cast housing for a plug connector which is generally identified by reference numeral 10. The zinc die-cast housing 10 comprises a first and a second housing part 12, 14 which are joined via a locking device 16 and rigid fastening elements 18. The first housing part 12 is formed as a socket housing and comprises four flange-type feet 20 (only two of which are shown in FIG. 1) at the side facing away from the joining area 36 with the second housing part 14, which are formed in the corner areas of the first housing part 12. Furthermore, openings 22 in the flange-type feet 20 are provided, which allow securing the socket housing by means of joining elements such as e.g. screws or the like at other elements.

Figure 2:
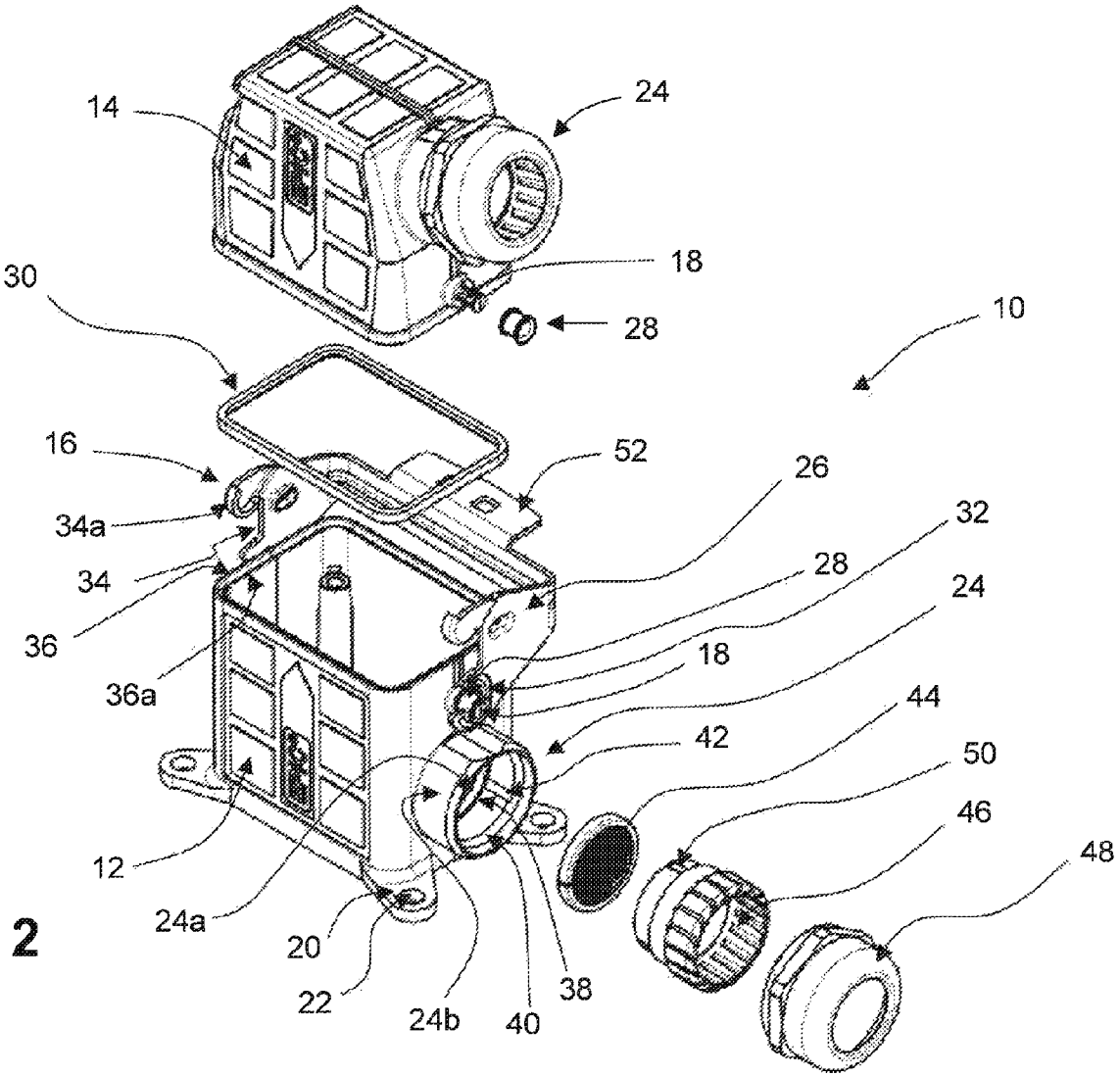
FIG. 2 shows an exploded illustration of the zinc die-cast housing according to FIG. 1.

The two housing parts 12, 14 of the zinc die-cast housing 10 of FIGS. 1 and 2 additionally comprise a receptacle device in the form of a threaded cable joint 24 which is adapted to receive a cable (not shown) and to apply electrical contact to same. The type of fastening of the cable will be discussed in more detail in the following with reference to FIG. 2.

FIG. 2 which is an exploded illustration of the zinc die-cast housing 10 of FIG. 1 shows the configuration of the individual elements which are additionally to be attached to the housing 10. The locking device 16 has the shape of a longitudinal clamp 26 which, in a plan view, is essentially U-shaped. In its essentially parallel longitudinal legs two fitting holes 32 and 34 are formed which are used to receive the fastening elements 18.

The fastening elements 18 are pin-shaped and protrude essentially orthogonally from the housing outer surface, as is shown in FIG. 2 by means of the fastening element 18 which is formed at the second housing part 14. Two pin-shaped fastening elements 18 are respectively formed in pairs in a direction facing away from one another and protrude from the respective housing part 12 or 14, respectively. Their longitudinal axes are in alignment so that the two pin-shaped fastening elements 18 of one pair form a longitudinal axis together.

The longitudinal clamp 26 is connected with one pair of these pin-shaped fastening elements 18 in such a manner that it may be pivoted about the longitudinal axis which is formed by the two fastening elements 18. As can be seen in FIG. 2, the fastening elements 18 of the first housing part 12 are inserted in the first fitting holes 32 of the longitudinal clamp 26 and constitute the axis of rotation for the pivoting motion of the longitudinal clamp 26. In the assembled state, i.e. when the two housing parts 12 and 14 are joined via the locking device 16 in the form of the longitudinal clamp 26, as shown in FIG. 1, the fastening elements 18 of the second housing part 14 arranged in pairs are inserted in the second fitting hole 34 of the longitudinal clamp 26. As can be seen in FIG. 2, the first fitting hole 32 comprises an opening which is open to one side in the circumferential direction, into which the fastening element 18 is inserted sideways and held by a resilient hook in the fitting hole 32.

As an alternative, it is, however, also conceivable to provide a first fitting hole 32 with a closed circumference. With such an embodiment, however, the longitudinal legs of the U-shaped longitudinal clamp 26 have to be resiliently deformable, at least in portions, so that by spreading the legs of the longitudinal clamp 26, the insertion of the pin-shaped fastening elements 18 into the closed first fitting hole 32 is enabled.

The second fitting hole 34 also comprises a latching protrusion 34*a* which, because of a higher friction at this place between the longitudinal clamp 26 and the fastening element 18 being inserted into the second fitting hole 34, fixes the longitudinal clamp 26 in the closed position, i.e. when the two housing parts 12 and 14 are joined via the same. An undesired pivoting of the longitudinal clamp 26 to the effect that the connection of the housing parts 12, 14 is separated is thereby effectively prevented.

The longitudinal clamp 26 further comprises an actuating handle 52 which may be operated in order to achieve a pivoting motion of the longitudinal clamp 26 for fixing or releasing the housing part 14 joined by it.

As can be seen from FIG. 2, bearing bushes 28 are provided which are used to offer increased wear resistance as well as reduced friction at the pin-shaped fastening elements 18. The bearing bushes 28 are mounted on the pin-shaped fastening elements 18 of the finish-cast housing part 12 and 14, respectively, and embossed. The bearing bushes 28 ensure an improved pivoting motion of the longitudinal clamp 26 due to the reduced friction as well as an increased life of the fastening elements 18 due to the improved resistance.

Furthermore, a sealing element 30 is provided which is arranged between the housing parts 12 and 14. In the embodiment of FIG. 2, the first housing part 12 is formed in the joining area 36 in such a manner that both the flush sealing ring 30 and a portion of the second housing part 14 may be accommodated therein. A shoulder 36*a* limits the joining area 36. In the illustrated embodiment, the sealing element 30 is made from electro-conductive nitrile rubber (NBR) or electro-conductive chloroprene rubber (NCR). The housing parts 12 and 14 remain in an electrically conductive connection with each other via the outer circumferential surface of the housing part 14 and the inner circumferential surface of the joining area 36 of the first housing part 10, even if an electrically non-conductive sealing element 30 is arranged between them.

The threaded cable joint 24 comprises an opening 24*a* as well as a collar 24*b* surrounding it. The collar 24*b* comprises a first step 38 and a second step 40 with corresponding shoulders at its inner circumference, as can be seen from FIG. 2. The steps 38, 40 prevent the elements inserted into the threaded cable joint 24 from entering the interior of the housing 10. A so-called skin-top brush 44, for example, which may be inserted into the threaded cable joint 24 as far as to the first shoulder, bears against the step 38. Further, an insert 46 is fitted in the threaded cable joint 24 and secured by means of a cap nut 48. For this purpose, the threaded cable joint 24 comprises a male thread (not shown) on its outer diameter which corresponds to the female thread of the cap nut 48.

As an alternative to such an embodiment as shown in FIGS. 1 and 2, a latching mechanism would, however, also be conceivable, wherein the cap nut 48 is formed in such a manner that it may be secured at the receptacle device.

Further, recesses 42 are provided in the inner circumference of the threaded cable joint 24, which correspond to protrusions 50 at the insert 46 and which prevent a relative rotation of the insert 46 with reference to the threaded cable joint 24.

In the manufacture of the zinc die-cast housing, the housing parts 12 and 14 are formed in corresponding casting moulds by means of the die cast method. The cast housing parts 12, 14 comprise both the fastening elements 18 and the receptacle device 24 and the flange-type feet 20 with the corresponding holes 22 for fastening. The casting mould is further adapted in such a manner that a male thread is simultaneously cast at the threaded cable joint 24, so that the housing parts after the die casting process step are finish-formed for an assembly of the additional elements, i.e. of the locking device 16, the sealing member 30, as well as the tops and inserts 44, 46, and 48. For accommodating and securing the respective inserts such as plugs or sockets in the interior of the housing 10, mounting surfaces (not shown) are provided in the housing parts 12 and 14, which, if necessary, may be provided with threaded holes in a further machining step for installing corresponding fastening screws.

As an alternative to the threaded holes which are formed in a further machining step for accommodating and fastening corresponding inserts in the interior of the housing 10, it is also possible to manufacture the housings of the plug connectors by die casting of zinc alloys without mechanical (finish-) machining. To this end, holes are to be provided in the mounting surfaces (e.g. four mounting surfaces, with another number being also possible) in order to make corresponding threads (e.g. M3) by forming. A separate thread forming step may be omitted by using self-cutting screws. In this case, the hole diameter need not be changed.

Die casting of zinc alloys has the advantage that a greater quantity of housing parts can be produced with a single form and corresponding tools than in a comparable method with aluminium alloys. Moreover, highly precise shapes may be cast with zinc and zinc alloys so that mechanical finish-machining, e.g. thread cutting or grinding of contact surfaces is no longer—or in a considerably smaller extent—necessary. The zinc die-cast housing comprises adequate hardness and mechanical strength so that it provides a good mechanical protection against e.g. shearing off of loaded portions such as the fastening elements. Due to the good electrical conductivity of zinc or zinc alloys, it may even be possible to dispense with coating the housing parts with an electro-conductive coating substance as it is known in the prior art.

Thus, an economic and simple manufacture of housing parts for a plug connector is ensured.

The invention claimed is:

1. A plug connector housing for establishing an electrical connection between the plug connector and a socket accommodating same, the housing comprising:

at least a first and a second housing part which are to be joined via a locking device and rigid fastening elements, and of which at least one housing part comprises a receptacle device for accommodating and applying electrical contact to a cable, wherein:

the rigid fastening elements and the at least one receptacle device each are integrally formed with the housing, and the rigid fastening elements are formed as pins which protrude in pairs from the respective housing part in mutually opposing directions, the locking device comprises a longitudinal clamp which is adapted to effect a connection between the rigid fastening elements of the first and second housing part, the housing parts are adapted to accommodate a sealing member in between, the first housing part overlaps the second housing part at least partially in the assembled condition of the housing, and the housing is a zinc die-cast housing.

2. The housing according to claim 1, wherein each housing part comprises a receptacle device for accommodating and applying electrical contact to a cable.

3. The housing according to claim 1, wherein the longitudinal clamp is adapted so as to be pivotably connectable with a pair of the pin-shaped fastening elements of the first housing part.

4. The housing according to claim 1, wherein the pins are adapted to accommodate bearing bushes.

5. The housing according to claim 1, wherein the receptacle device comprises an opening which is formed in the housing and a collar surrounding the opening.

6. The housing according to claim 5, wherein holding means are provided at the collar for fastening the cable at the receptacle device.

7. The housing according to claim 6, wherein the holding means for fastening the cable comprise a male thread.

8. A plug connector housing for establishing an electrical connection between the plug connector and a socket, the plug connector housing comprising:

a first and a second housing part joinable via a locking device and rigid fastening elements, such that the first housing part overlaps the second housing part at least partially in the joined condition of the housing, at least one of the first and second housing parts comprises a receptacle device for accommodating and applying electrical contact to a cable, the first and second housing parts being adapted to accommodate a sealing member in between, wherein:

the rigid fastening elements and the at least one receptacle device each are integrally formed with the housing;

the rigid fastening elements comprises pins protruding in pairs from the respective housing part in mutually opposing directions;

the locking device comprises a longitudinal clamp extending from a given side of the first and second housing parts to a side opposite the given side of the first and second housing parts, wherein the longitudinal clamp is configured to receive the pins of the rigid fastening elements to effect a connection between the rigid fastening elements of the first and second housing part; and the housing is a zinc die-cast housing.

* * * * *